US007191850B2

(12) United States Patent
Williams

(10) Patent No.: US 7,191,850 B2
(45) Date of Patent: Mar. 20, 2007

(54) FORMATION DIP GEO-STEERING METHOD

(76) Inventor: Danny T. Williams, 1210 Seabury Ct., Katy, TX (US) 77494

( * ) Notice: Subject to any disclaimer, the term of this patent is extended or adjusted under 35 U.S.C. 154(b) by 146 days.

(21) Appl. No.: 10/975,966

(22) Filed: Oct. 28, 2004

(65) Prior Publication Data

US 2006/0090934 A1 May 4, 2006

(51) Int. Cl.
*E21B 25/16* (2006.01)
*E21B 47/02* (2006.01)

(52) U.S. Cl. ..... 175/45; 702/11; 324/339

(58) Field of Classification Search ..... 702/1–16; 175/45; 324/336, 339
See application file for complete search history.

(56) References Cited

U.S. PATENT DOCUMENTS 514,170 A * 2/1894 Tesla ..... 313/315
3,823,787 A * 7/1974 Haworth et al. ..... 340/853.6
5,311,951 A 5/1994 Kyte et al.
5,678,643 A * 10/1997 Robbins et al. ..... 175/45
6,556,016 B2 * 4/2003 Gao et al. ..... 324/343
6,643,589 B2 * 11/2003 Zhang et al. ..... 702/7
6,819,111 B2 * 11/2004 Fanini et al. ..... 324/339

* cited by examiner

*Primary Examiner*—Michael Nghiem
*Assistant Examiner*—Victor J Taylor
(74) *Attorney, Agent, or Firm*—C. Dean Dominque; Robert L. Waddell; Ted M. Anthony

(57) ABSTRACT

A method of drilling a well includes calculating and estimating the dip angle, wherein said estimated dip angle being based on offset well data, seismic data, core data, pressure data. Next, the method includes drilling a well with a logging while drilling tool using the estimated formation dip angle so that real time logging data is generated along with the drilling data and calculating an instantaneous formation dip angle. Next, the real time logging data is obtained and a target formation window is projected ahead of the well path that includes a top of formation and a bottom formation. The method includes monitoring the real time logging and drilling data and drilling the well through the target formation window. The method further includes changing the estimated instantaneous formation dip based on the obtained data and adjusting the target formation top window and the bottom formation window.

2 Claims, 6 Drawing Sheets

Dip Calculation:

Inverse Tangent ({top of target in 16 – top of target in 8} / distance between wells) = Dip in deg./100'

Example: Inverse Tangent ({2200' – 2280'} / 5000' = - 0.9167 deg./100' *

* Negative sign indicates down dip and positive sign indicates up dip.

Figure 1: Surface elevation with Formation of interest contour map. Also with offset well locations and formation thickness (isopac mapping)

Scale 1"=300'

Dip Calculation:

Inverse Tangent ({top of target in 16 – top of target in 8} / distance between wells) = Dip in deg./100'

Example: Inverse Tangent ({2200' – 2280'} / 5000' = - 0.9167 deg./100' *

* Negative sign indicates down dip and positive sign indicates up dip.

| I | | II | | | III |
|---|---|---|---|---|---|
| OFFSET WELL | | TVD | MD | GR | VERTICAL DRIFT |
| 1010' | 106 | 1010.0 | 1010.0 | 100 | 100' |
| 1012' | 110 | 1015.0 | 1316.0 | 10 | 300' |
| 1012' | 112 | 1020.0 | 1822.0 | 10 | 800' |

| I | | II | | | III |
|---|---|---|---|---|---|
| OFFSET WELL | | TVD | TD | GR | VERTICAL DRIFT |
| 1009' | 114 | 1021.0 | 2225.0 | 40 | 1200' |
| 1010' | 116 | 1023.0 | 2327.0 | 10 | 1300' |
| 1015' | 118 | 1025.0 | 2530.0 | 90 | 1500' |

| I | | II | | | III |
|---|---|---|---|---|---|
| OFFSET WELL | | TVD | TD | GR | VERTICAL DRIFT |
| 1013.5' | 120 | 1021.0 | 2635.0 | 65 | 1575' |
| 1013.0' | 122 | 1023.0 | 3136.0 | 35 | 2035' |
| 1012.5' | 124 | 1025.0 | 3337.0 | 20 | 2175' |

FORMATION DIP GEO-STEERING METHOD

BACKGROUND OF THE INVENTION

This invention relates to a method of steering a drill bit. More specifically, but not by way of limitation, this invention relates to a method of geo-steering a bit while drilling directional and horizontal wells.

In the exploration, drilling and production of hydrocarbons, it becomes necessary to drill directional and horizontal wells. As those of ordinary skill in the art appreciate, directional and horizontal wells can increase the production rates of reservoirs. Hence, the industry has seen a significant increase in the number of directional and horizontal wells drilled. Additionally, as the search for hydrocarbons continues, operators have increasingly been targeting thin beds and/or seams with high to very low permeability. The industry has also been targeting unconventional hydrocarbon reservoirs such as tight sands, shales, and coal.

Traditionally, these thin bed reservoirs, coal seams, shales and sands may range from less than five feet to twenty feet. In the drilling of these thin zones, operators attempt to steer the drill bit within these zones. As those of ordinary skill in the art will recognize, keeping the well bore within the zone is highly desirable for several reasons including, but not limited to, maintaining greater drilling rates, maximizing production rates once completed, limiting water production, preventing well bore stability problems, exposing more productive zones, etc.

Various prior art techniques have been introduced. However, all these techniques suffer from several problems. For instance, in the oil and gas industry, it has always been an accepted technique to gather surface and subsurface information and then map or plot the information to give a better understanding of what is actually happening below the earth's surface. Some of the most common mapping techniques used today include elevation contour maps, formation contour maps, sub sea contour maps and formation thickness (isopac) maps. Some or most of these can be presented together on one map or separate maps. For the most part, the information that is gathered to produce these maps are from electric logging and real time measurement while drilling and logging devices (gamma ray, resistivity, density neutron, sonic or acoustic, surface and subsurface seismic or any available electric log). This type of data is generally gathered after a well is drilled. Additionally, measurement while drilling and logging while drilling techniques allow the driller real time access to subterranean data such as gamma ray, resistivity, density neutron, and sonic or acoustic and subsurface seismic. This type of data is generally gathered during the drilling of a well.

These logging techniques have been available and used by the industry for many years. However, there is a need for a technique that will utilize historical well data and real time down hole data to steer the bit through the zone of interest. There is a need for a method that will produce, in real time during drilling, an instantaneous dip for a very thin target zone. There is also a need for a process that will utilize the instantaneous dip to produce a calculated target window (top and bottom) and extrapolate this window ahead of the projected well path so an operator can keep the drill bit within the target zone identified by the calculated dip and associated calculated target window. These, and many other needs will be met by the invention herein disclosed.

SUMMARY OF THE INVENTION

A method of drilling a well is disclosed. The method includes selecting a target subterranean reservoir and estimating the formation depth of the target reservoir. The method further includes calculating an estimated formation dip angle of the target reservoir based on data selected from the group consisting of: offset well data, seismic data, core data, and pressure data. Then, the top of the target reservoir is calculated and then the bottom of the target reservoir is calculated so that a target window is established.

The method further includes projecting the target window ahead of the intended path and drilling the well. Next, the target reservoir is intersected. The target formation is logged with a measurement while drilling means and data representative of the characteristics of the reservoir is obtained with the measurement while drilling means selected from the group consisting of, but not limited to: gamma ray, density neutron, sonic or acoustic, subsurface seismic and resistivity. The method further includes, at the target reservoir's intersection, revising the top of the target reservoir and revising the bottom of the target reservoir to properly represent their position in relationship to the true stratigraphic position (TSP) of the drill bit, through dip manipulation to match the real time log data to correlate with the offset data, and thereafter, projecting a revised target window.

The method further comprises correcting the top of the target reservoir and the bottom of the target reservoir through dip manipulation to match the real time logging data to the correlation offset data to directionally steer the true stratigraphic position of the drill bit and stay within the new calculated target window while drilling ahead. In one preferred embodiment, the step of correcting the top and bottom of the target reservoir includes adjusting an instantaneous formation dip angle (ifdip) based on the real time logging and drilling data's correlation to the offset data in relationship to the TSP of the drill bit so that the target window is adjusted (for instance up or down, wider or narrower), to reflect the target window's real position as it relates to the TSP of the drill bit. The method may further comprise drilling and completing the well for production.

In the one of the most preferred embodiments, the estimated formation dip angle is obtained by utilizing offset well data that includes offset well data such as electric line logs, seismic data, core data, and pressure data. In one of the most preferred embodiments, the representative logging data obtained includes a gamma ray log.

An advantage of the present invention includes use of logs from offset wells such as gamma ray, resistivity, density neutron, sonic or acoustic, and surface and subsurface seismic. Another advantage is that the present invention will use data from these logs and other surface and down hole data to calculate a dip for a very thin target zone. Yet another advantage is that during actual drilling, the method herein disclosed will produce a target window (top and bottom) and extrapolate this window ahead of the projected well path so an operator can keep the drill bit within the target zone identified by the ifdip and target window.

A feature of the present invention is that the method uses real time drilling and logging data and historical data to recalculate the instantaneous dip of the target window as to its correlation of the real time logging data versus the offset wells data in relationship to the TSP of the drill bit within the target window. Another feature is that the method will then produce a new target window (top and bottom) and wherein this new window is extrapolated outward. Yet another feature is that this new window will be revised based on actual data acquired during drilling such as, but not limited to, the real time gamma ray indicating bed boundaries. Yet another feature is that the projection window is controlled by the top of the formation of interest as well as the bottom of the formation of interest. In other words, a new window will be extrapolated based on real time information adjusting the top and/or bottom of the formation of interest as it relates to the TSP of the drill bit within that window, through the correlation of the real time logging and drilling data to the offset well data.

DETAILED DESCRIPTION OF THE PREFERRED EMBODIMENTS

Figure 1:
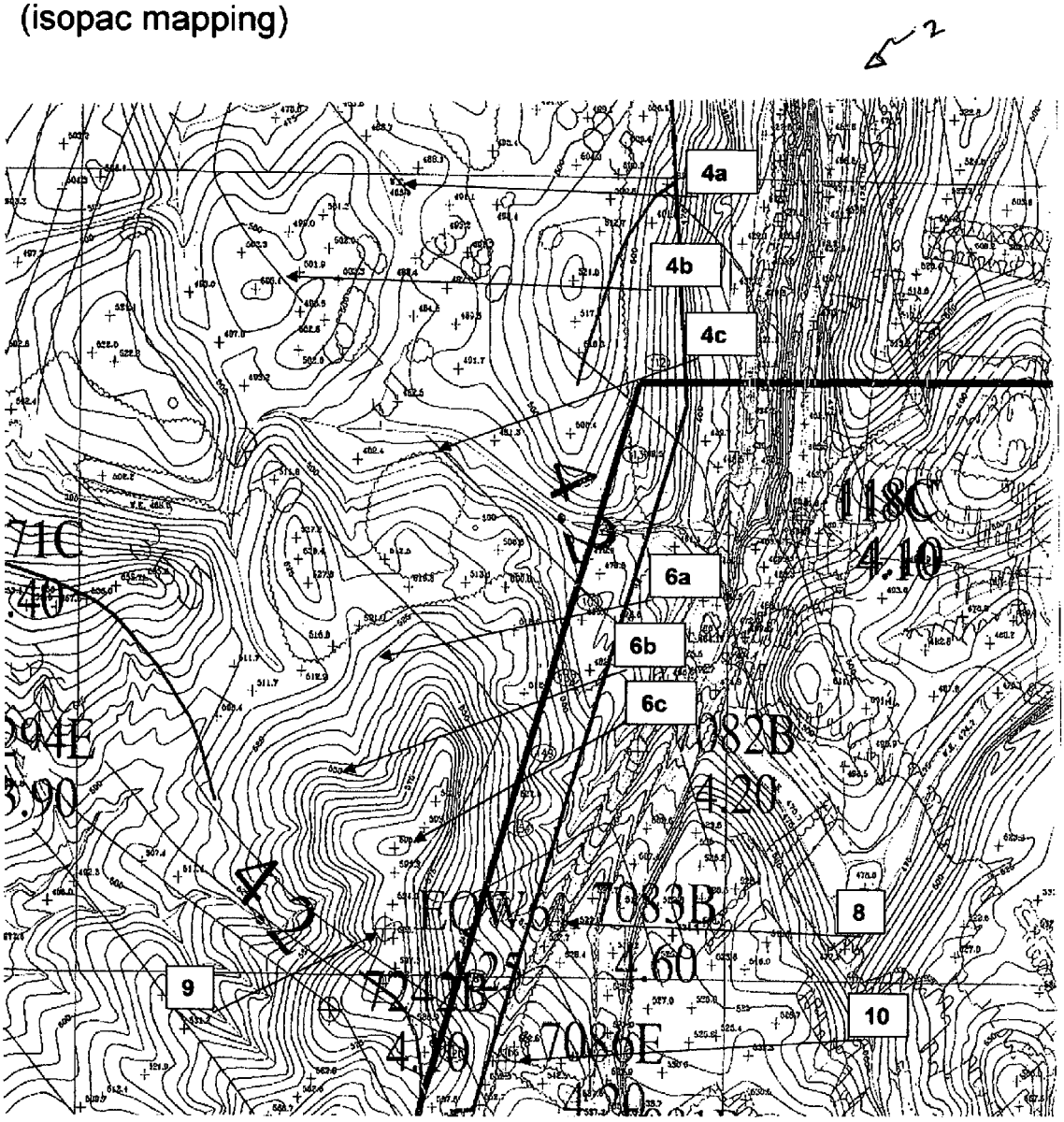
FIG. 1 is a surface elevation and formation of interest contour map with offset well locations.

Referring now to FIG. 1, a surface elevation with formation of interest contour map 2 with offset well locations will now be described. As seen in FIG. 1, the subsurface top of target formation of interest (FOI) contour lines (see generally 4*a*, 4*b*, 4*c*) are shown. Also shown in FIG. 1 is the surface elevation lines (see generally 6*a*, 6*b*, 6*c*). FIG. 1 also depicts the offset well location 8, 9 and 10, and as seen on the map, these offset well locations contain the target formation window thickness as intersected by those offset wells.

As understood by those of ordinary skill in the art, map 2 is generated using a plurality of tools such as logs, production data, pressure buildup data, and core data from offset wells 8, 9 and 10. Geologist may also use data from more distant wells. Additionally, seismic data can be used in order to help in generating map 2.

Figure 2:
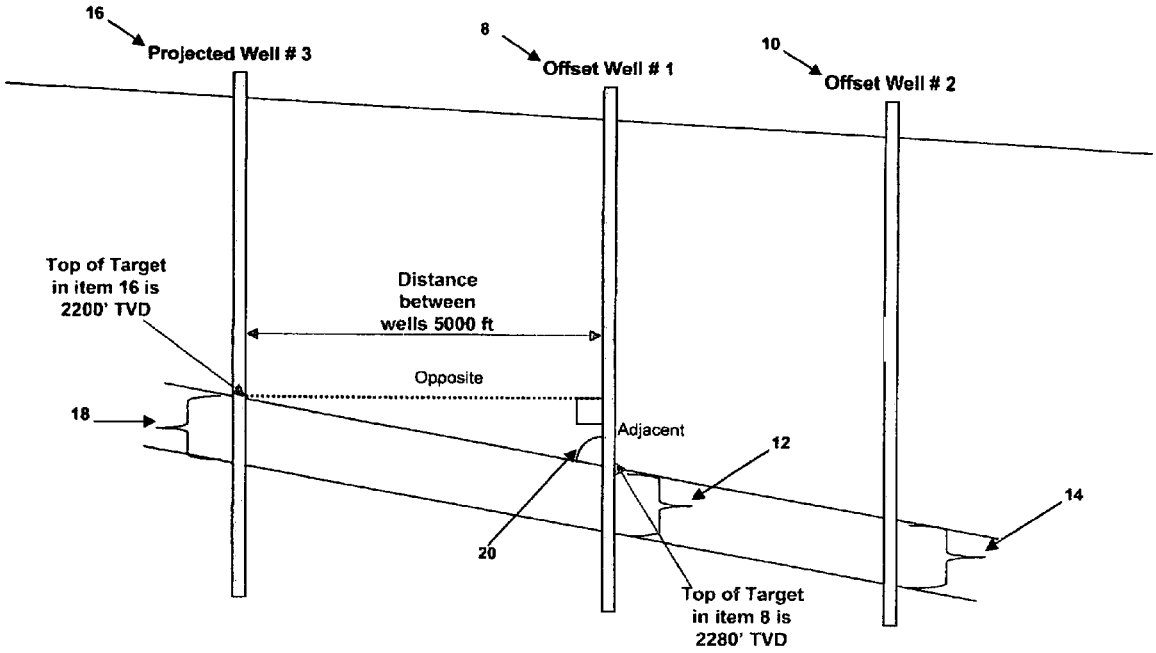
FIG. 2 is a partial cross-sectional geological view of two offset wells and a proposed well along with a dip calculation example.

Referring now to FIG. 2, a partial cross-sectional geological view of two offset wells and a proposed well 16 is shown. More specifically, FIG. 2 depicts the offset well 8 and the offset well 10. The target formation of interest, which will be a subterranean reservoir in one embodiment, is identified in well 8 as 12, and in well 10 as 14. The formation of interest is shown in an up dip orientation from offset wells 10 to 8 in relationship to the position of the proposed well 16.

The proposed well 16 is shown up dip relative to wells 8 and 10, and the formation of interest that would intersect the proposed well bore is denoted as numeral 18. An operator may wish to drill the well bore slightly above the formation of interest, or until the top of the target formation of interest, or through the formation of interest, and thereafter kick-off at or above the target formation of interest drilling a highly deviated horizontal well bore to stay within the target formation of interest. FIG. 2 depicts wherein the formation dip angle can be readily ascertained. For instance, the angle at 20 is known by utilizing the geometric relationship well known in the art. For example, the operator may use the tangent relationship, wherein the tangent is equal to the opposite side divided by the adjacent side and the ratio is then converted to degrees-hence, the formation dip angle is easily calculated. It should be noted that other factors can be taken into account when calculating the formation dip angle as noted earlier. Data from seismic surveys can be used to modify the formation dip angle as readily understood by those of ordinary skill in the art.

In the most preferred embodiment, the dip is calculated as follows:

([top of target in proposed well 16–top of target in offset well 8]/distance between wells)×inverse tangent=dip in degrees/100'.

Therefore, assuming that the top of the target in well 16 is 2200' TVD, the top of the target in well 8 is 2280', and the distance between the wells is 5000', the following calculation provides the dip angle:

([2200'−2280']/5000')×inverse tangent=−0.9167 degrees/100'

{note: the negative sign indicates down dip and positive sign indicates up dip}

Figure 3:
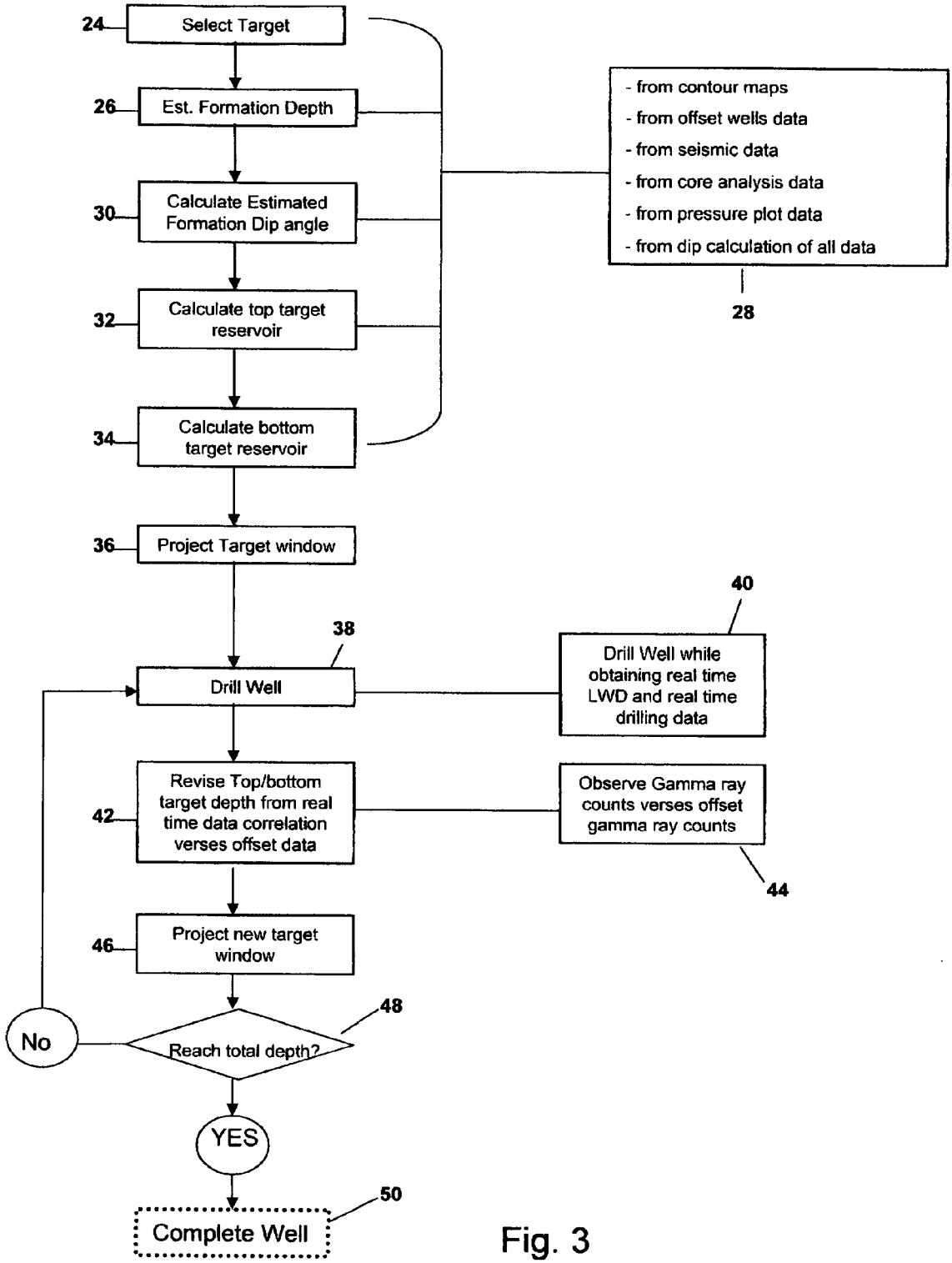
FIG. 3 is a flow chart of the method of one of the most preferred embodiments of the present invention.

Referring now to FIG. 3, a flow chart of one of the most preferred embodiments of the method of the present invention is illustrated. Initially, a target formation of interest is selected 24. An estimation of the formation depth of the target formation is calculated 26 utilizing known techniques and uses input data from the map 2, offset well data, seismic data, and contour maps (step seen generally at 28), as noted earlier. The method further includes calculating the estimated formation dip angle 30. One of the preferred methods of determining the formation dip angle was described with reference to FIG. 2 (and as seen in the example dip calculation previously presented). Parameters used to calculate the formation dip angle were described with reference to step 28, which includes utilizing the map 2, offset well data, seismic data, etc.

Next, the method includes calculating a top of the formation of interest 32 and then a bottom of the formation of interest 34. The method comprises projecting this top and bottom target window 36 which includes as it starting frame the top of formation 32 and the bottom of formation 34. Once the target window is selected, the operator can begin drilling the well 38. As appreciated by those of ordinary skill in the art, the drill string will have measurement while drilling (MWD) and/or logging while drilling (LWD) tools 40 which will log the formation for real time subterranean information. The information may be resistivity, gamma ray, neutron density, etc. There will also be real time drilling data being recorded such as rate of penetration (ROP), torque and drag, formation returns at the surface, rotating speed, weight on bit (WOB), etc.

Based on the observed data from the LWD tools 40 and real time drilling data, the top and bottom of the formation will be revised 42 through instantaneous dip manipulation to match the real time logging and drilling data as it correlates to the offset data, to properly represent their position in relationship to the TSP of the drill bit. The calculated formation dip angle at any particular instance during the drilling process is referred to as the instantaneous formation dip angle (ifdip). The revisions will be based on the observed data and its relationship to the TSP of the drill bit through the correlation of the real time logging data versus the offset well data. The TSP is determined by using the real time logging data and drilling data and correlating it to the offset wells data to locate the TSP of the bit within the well's target window.

Based on where the TSP of the drill bit is, a dip will be created that will reposition the target window around the TSP of the drill bit. This dip will then be used to change the target window and project it ahead for further drilling. In the most preferred embodiment, the data will be the gamma ray API counts 44. Normally, the gamma ray counts indicative of a hydrocarbon reservoir, and in this embodiment are between 0 and 50 API units. With the revised top FOI and bottom FOI, a new target window can be projected 46. If the bit goes outside the projected window (i.e. either above the top of the formation of interest or below the formation of interest), the ifdip is incorrect and a new window, and in turn a new ifdip, is calculated as per the teachings of this invention.

If the total depth has been reached (as seen in step 48), then drilling can cease and the well can be completed using conventional completion techniques 50. If the total depth has not been reached, then the method includes returning to step 38 and wherein the loop repeats i.e. the drilling continues, LWD data is obtained, the top and bottom of the FOI is revised (42) and a new target window is generated and projected (46).

Figures 4A, 4B:
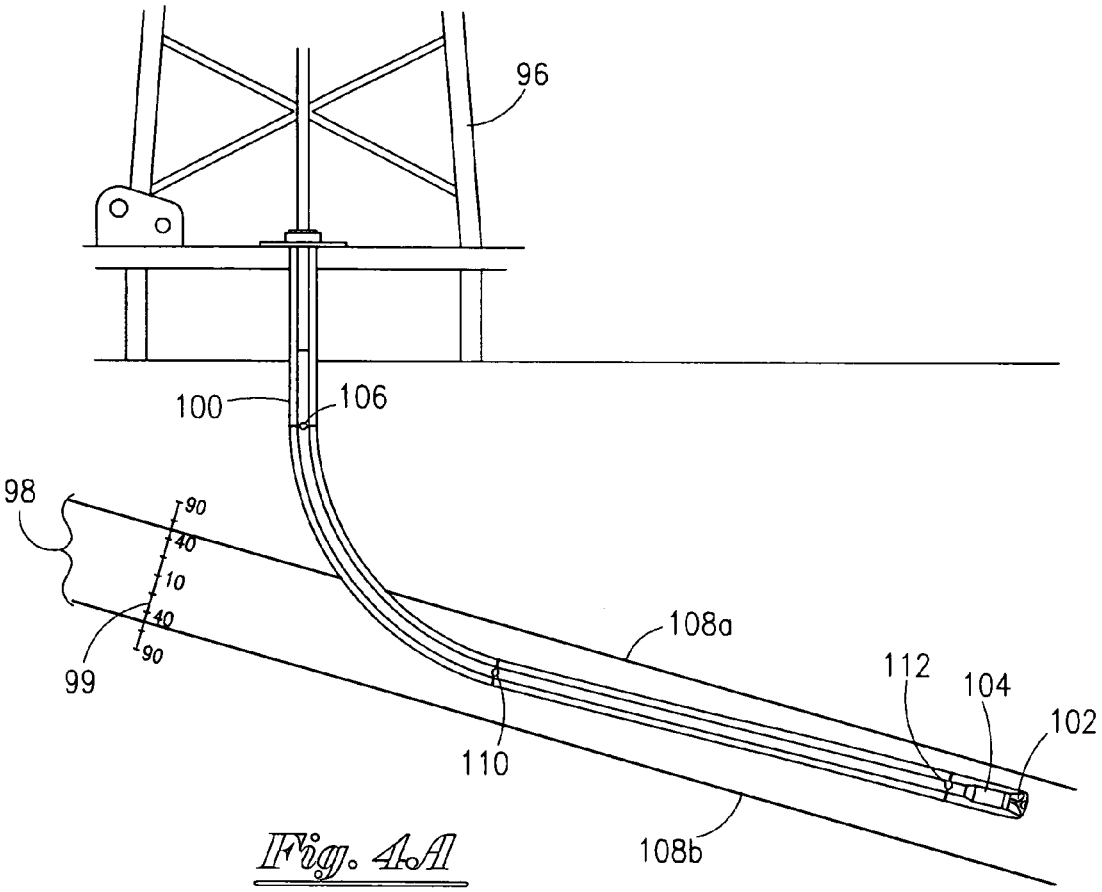
FIG. 4A is a schematic view of a deviated well being drilled from a rig.
FIG. 4B is a chart of gamma ray data obtained from the well seen in FIG. 4A.

Referring now to FIG. 4A, a schematic view of a deviated well being drilled from a rig 96 will now be described. As will be appreciated by those of ordinary skill in the art, a well is drilled into the subterranean zones. The target zone is indicated by the numeral 98, and wherein the target zone 98 has an estimated formation dip angle as set out in step 30 of FIG. 3 (the calculation was previously presented). Returning to FIG. 4A, the offset well log data for zone 98 is shown in numeral 99 for the target zone wherein 99 represents the distribution of gamma counts through the target zone 98 as based on the offset well data.

Figures 5A, 5B:
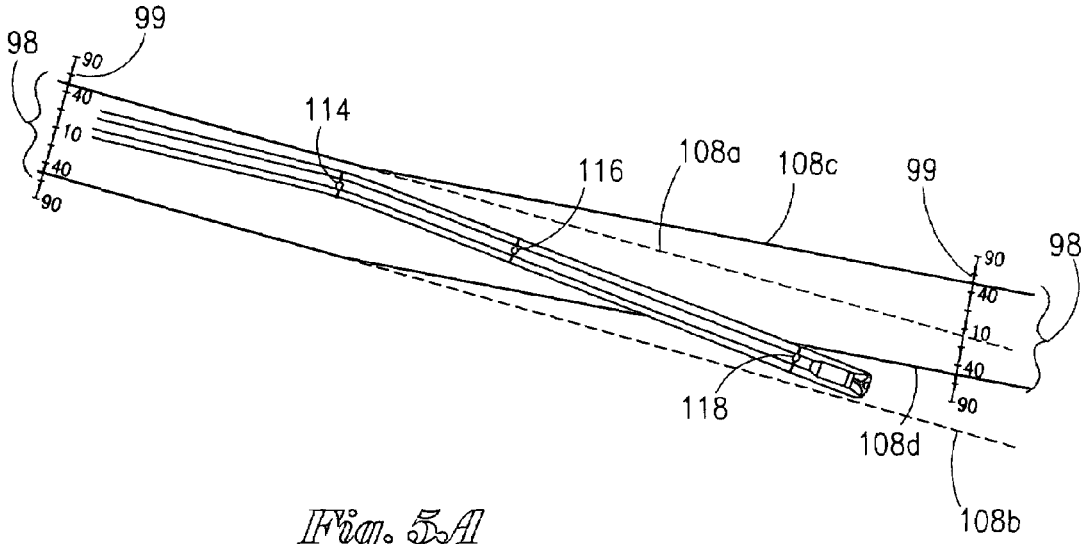
FIG. 5A is the schematic seen in FIG. 4A after further extended drilling.
FIG. 5B is a chart of gamma ray data obtained from the well seen in FIG. 5A.
Figures 6A, 6B:
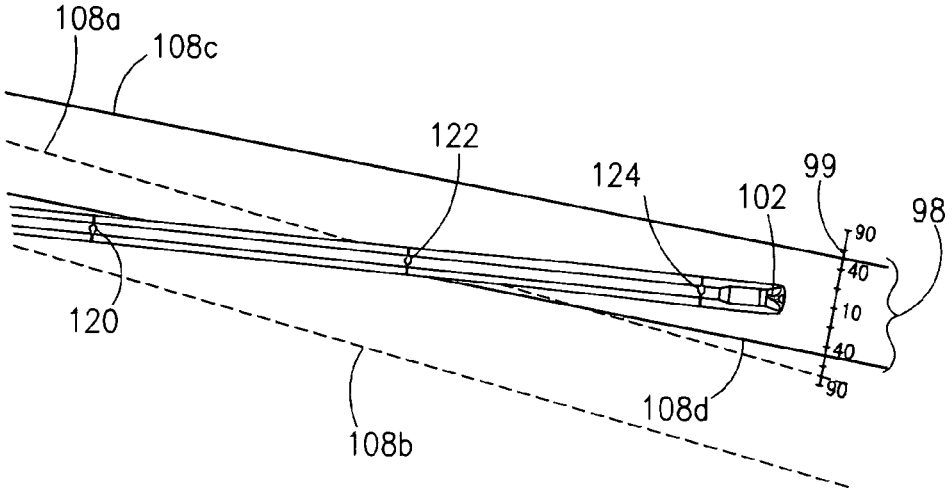
FIG. 6A is the schematic seen in FIG. 5A after further extended drilling.
FIG. 6B is a chart of gamma ray data obtained from the well seen in FIG. 6A.

The well being drilled is denoted by the numeral 100. The operator will drill the well with a drill bit 102 and associated logging means such as a logging while drilling means (seen generally at 104). During the drilling, the operator will continue to correlate the geologic formations being drilled to the offset well drilling and logging data (99) as it relates to the real time drilling and logging data. Once the operator believes that the well 100 is at a position to kick off into the target zone 98, the operator will utilize conventional and known directional techniques to effect the side track, as will be readily understood by those of ordinary skill in the art. A slant well technique, as understood by those of ordinary skill in the art, can also be employed to drill through the target zone, logging it, identify the target zone, plug back and sidetrack to intersect the zone horizontally. As seen at point 106, the operator, based on correlation to known data, kicks off the well 100 utilizing known horizontal drilling techniques. As seen in FIG. 4B, a chart records real time logging data, such as gamma ray counts from the well 100. The charts seen in FIGS. 4B, 5B, and 6B depict three (3) columns: column I shows the true vertical depth (TVD) of the offset well's associated gamma counts previously discussed with reference to numeral 99; column II is the actual well data from well 100; and, column III is the vertical drift distance of the actual well 100 from the surface location.

Hence, at point 106, the well is at a true vertical depth of 1010', a measured depth of 1010' and the gamma ray count is at 100 API units; the depth of the bit relative to the offset well's associated gamma count is 1010'. The estimated formation dip angle is calculated at point 106 by the methods described in FIG. 3, step 30 and in the discussion of FIG. 2. The correlation of the offset well data (99) to the real time logging data verifies that the estimated formation dip angle currently being used accurately positions the drill bit's TSP in relationship to the target window. Based on this correlation, the estimated formation dip angle can be used as the ifdip to generate the target window to drill ahead. As noted earlier, the ifdip is the instantaneous formation dip angle based on real time logging and drilling data correlation to offset well logging and drilling data as it relates to the TSP of the drill bit.

As noted earlier, the operator kicks off into the target zone 98. As per the teachings of the present invention, a top of formation of interest and a bottom of formation of interest has been calculated via the estimated formation dip angle, which in turn defines the window. Moreover, this window is projected outward as seen by projected bed boundaries 108*a*, 108*b*. The LWD means 104 continues sending out signals, receiving the signals, and transmitting the received processed data to the surface for further processing and storage as the well 100 is drilled. The top of the formation of interest is intersected and confirms that the estimated formation dip angle used is correct. The operator, based on the LWD information and the formation of interest top intersection can use the current estimated formation dip and project the window to continue drilling, which in effect becomes the instantaneous formation dip angle (ifdip). As noted at point 110, the well is now at a true vertical depth of 1015', a total depth of 1316' and the real time gamma ray count at 10 API units.

The correlation of the offset well data (99) and real time logging data verify that the drill bit's true stratigraphic position (TSP) is within the target window. The ifdip, according to the teachings of the present invention, can be changed if necessary to shift the top and bottom window so they reflect the drill bit's TSP within the window. Since the gamma count reading is 10, it correlates to the offset wells (99) 10 gamma count position. Therefore, the actual collected data confirms that the well 100, at point 110, is positioned within the target window when the drill bit's TSP at point 110 was achieved. The instantaneous formation dip angle (ifdip) is calculated at point 110 by the following: inv. tan. [(offset well TVD−real time well TVD)/distance between points]=−0.57 29 degrees/100', and is used to shift the window in relationship to the drill bit's TSP, and can now be used to project the window ahead so drilling can continue.

As seen in FIG. 4A, the operator continues to drill ahead. The operator actually drills a sightly more up-dip bore hole in the window as seen at point 112. As seen in FIG. 4B, the LWD indicates that the true vertical depth is 1020', the measured depth is 1822' and the gamma ray count is 10 API units, confirming the projected window is correct. The previous instantaneous formation dip angle (ifdip) can continue to be used since the real time logging data at point 112 correlates to the offset log data 99 as it relates to the drill bit's TSP within the target window, and is calculated at point 112 by the following: inv. tan. [(offset well TVD−real time well TVD)/distance between points]=−0.57 29 degrees/100'.

Referring now to FIG. 5A, a schematic representation of the continuation of the extended drilling of well 100 seen in FIG. 4A will now be described. At point 114, the LWD indicates that the true vertical depth is 1021', the measured depth is 2225' and the real time gamma ray count is 40 API units. The vertical drift distance from the surface location is 1200'. Thus, the correlation between the real time gamma ray count and the offset gamma ray count (99) verifies the drill bit's TSP is within the target window and the projected window continues to be correct as seen by applying the already established calculation. At point 116, the drill bit has stayed within the projected window, and the chart in FIG. 5B indicates that the true vertical depth is 1023' while the measured depth is 2327' and the gamma ray count is 10; the vertical drift distance from the surface location is 1300'. Hence, as per the correlation procedure previously discussed, the projected window is still correct. The instantaneous formation dip angle is calculated at point 116 by the following: inv. tan. [(offset well TVD−real time well TVD)/distance between points]=−0.57 29 degrees/100'. The same ifdip can be used to project the window ahead to continue drilling.

At point 118 of FIG. 5A, the driller has drilled ahead slightly more down dip. The projected window indicates that the bit should still be within the projected window. However, the chart seen in FIG. 5B indicates that the bit has now exited the projected window by the indication that the gamma ray counts are at 90 API units. Note that the true vertical depth is 1025' and the measured depth is 2530, and the vertical drift distance is 1500'. Therefore, as per the teachings of the present invention, the projected window requires modification. This is accomplished by changing the instantaneous formation dip angle (ifdip) so that the drill bit's TSP is located below the bottom of the target window just enough to lineup the real time logging gamma data to the offset well gamma data (99). This is accomplished by decreasing the target formation window's dip angle just enough to line up the correlation stated above. The instantaneous formation dip angle is calculated at point 118 by the following: inv. tan. [(offset well TVD−real time well TVD)/distance between points]=−0.3820 degrees/100' down dip. Based on this new formation dip angle, the top of the formation window is now indicated at 108*c* and the bottom of the formation window is now indicated at 108*d*. FIG. 5A indicates that the dip angle for the target reservoir does in fact change, and a new window with the new instantaneous formation dip angle is projected from this stratigraphic point on and drilling can proceed. Note the previous window boundaries of 108*a* and 108*b*.

Referring now to FIG. 6A, the new window has been projected i.e. window boundaries 108*c* and 108*d*. The instantaneous formation dip angle (ifdip), as per the teachings of this invention, indicate that the dip angle of the formation of interest has changed to reflect the drill bit's TSP from the correlation of real time logging and drill data to offset data and the target formation window adjusted to the new instantaneous formation dip angle. At point 120, the operator has begun to adjust the bit inclination so that the bit is heading back into the new projected window. As noted earlier, the bottom formation of interest 108*d* and the top formation of interest 108*c* has been revised. FIG. 6B confirms that the bit is now at a true vertical depth of 1024' and a total depth of 1035' at point 120, wherein the gamma ray count is at 65 units. The instantaneous formation dip angle is calculated at point 120 by the following: inv. tan. [(offset well TVD−real time well TVD)/distance between points]=−0.3820 degrees/100'. The correlation procedure mentioned earlier of using the offset well gamma data 99 to compare with real time data indicates that the adjustment made to the bit inclination has indeed placed the drill bit's TSP right below the new target window's bottom. This is shown by the real time logging data gamma ray unit of 65 units (see FIG. 6B) lining up with the offset well's gamma ray unit of 65 units (99) below the new target formation window that was created with the previous instantaneous dip angle at point 118.

At point 122, the operator has maneuvered the bit back into the projected window. The real time data found in FIG. 6B confirms that the bit 102 has now reentered the target zone, as well as being within the projected window, wherein the TVD is 1026.5' and the measured depth is 3136' and the gamma ray count is now at 35 API units. The instantaneous formation dip angle (ifdip) used on the projected window is now verified by the correlation procedure mentioned earlier being based on the instantaneous dip formation angle of −0.3820 degrees/100'. The point 124 depicts the bit within the zone of interest according to the teachings of the present invention. As seen in FIG. 6B, at point 124, the bit is at a true vertical depth of 1027' and a measured depth of 3337'. The gamma ray reads 20 API units therefore confirming that the bit is within the zone of interest. The instantaneous formation dip angle (ifdip) can now be used to project the target window ahead and drilling can continue. The instantaneous formation dip angle is calculated at point 124 by the following: inv. tan. [(offset well TVD−real time well TVD)/distance between points]=−0.3820 degrees/100'. Any form of drilling for oil and gas, utility crossing, in mine drilling and subterranean drilling (conventional, directional or horizontally) can use this invention's method and technique to stay within a target zone window.

Although the invention has been described in terms of certain preferred embodiments, it will become apparent that modifications and improvements can be made to the inventive concepts herein without departing from the scope of the invention. The embodiments shown herein are merely illustrative of the inventive concepts and should not be interpreted as limiting the scope of the invention.

I claim:

1. A method of drilling a well with a bit comprising:

a. Calculating an estimated formation dip angle, wherein said estimated formation dip angle being based on offset well data, seismic data, core data, pressure data;

b. Drilling a well with a logging while drilling means so that real time logging data is generated;

c. Collecting drilling data at the surface;

d. Processing said real time logging data and drilling data, and wherein said real time logging data includes gamma ray and resistivity, and said drilling data includes rate of penetration, torque and drag, rotating speed, weight on bit, and drilling returns at surface;

e. Calculating an instantaneous formation dip angle (ifdip) based on the real time representative logging and drilling data correlated to the estimated formation dip angle data wherein the step of calculating the ifdip includes obtaining the tangent of the amount of rise of the formation over the amount of run of the formation based on a known distance;

f. Projecting a target formation window ahead of the well that includes a top of formation and a bottom formation based on said ifdip so that a well path is created;

g. Monitoring the real time logging data and drilling data;

h. Drilling the well with the bit through the target formation window so that the bit stays within said target formation window;

i. Changing the ifdip based on the real time representative logging data and drilling data correlated to the offset well data;

j. Adjusting the target formation window;

k. Correcting the well path to stay within the target formation window by adjusting the ifdip based on real time representative logging data and drilling data correlated to the offset well data;

l. Drilling the well within the target formation window to the predetermined location; and, completing the well.

2. A method of drilling a well with a bit comprising:

a. Calculating an estimated formation dip angle, wherein said estimated formation dip angle being based on offset well data and further includes utilizing core data, seismic data and pressure data;

b. Drilling a well with a logging while drilling using estimated formation dip angle so that real time logging data is generated wherein said real time logging data includes gamma ray and resistivity and said drilling data includes rate of penetration, torque and drag, rotating speed, weight on bit, and drilling returns at the surface;

c. Obtaining said real time logging data;

d. Obtaining drilling data at the surface;

e. Calculating an instantaneous formation dip angle (ifdip);

f. Determining a true stratigraphic position (TSP) of the bit based on the real time logging data and drilling data;

g. Projecting a target formation window ahead of the bit so that a well path is created that includes a top of formation and a bottom of formation based on said ifdip;

h. Monitoring the real time logging and drilling data;

i. Drilling the well with the bit so that the bit stays within the target formation window;

j. Changing the ifdip based on real time logging data and drilling data so that the top and bottom of the formation of interest is adjusted as it relates to the TSP of the bit within the target formation window, through the correlation of the real time logging and drilling data to the offset well data;

k. Correcting the well path to stay within the target formation window by adjusting the ifdip based on the real time logging data and the drilling data;

l. Drilling the well within the corrected well path with the bit to a predetermined location; and completing the well for production.

* * * * *